United States Patent [19]

Dehne et al.

[11] Patent Number: 4,669,388

[45] Date of Patent: Jun. 2, 1987

[54] METHOD OF AND APPARATUS FOR ADVANCING CONVEYOR CARRIERS THROUGH A WORK STATION

[75] Inventors: Clarence A. Dehne, Farmington Hills; George D. MacMunn, Southfield, both of Mich.

[73] Assignee: Jervis B. Webb Company, Farmington Hills, Mich.

[21] Appl. No.: 607,199

[22] Filed: May 4, 1984

[51] Int. Cl.[4] ..... B61B 13/00

[52] U.S. Cl. ..... 104/162; 104/96; 104/290; 104/172.3; 198/465.4

[58] Field of Search ..... 104/96, 162, 172 B, 104/103, 290; 198/473, 487, 741, 747, 619, 470.1, 744, 465.4, 474.1

[56] References Cited

U.S. PATENT DOCUMENTS

| | | | |
|---|---|---|---|
| 724,831 | 4/1903 | Evans | 198/741 |
| 3,403,633 | 10/1968 | Schwarz Kopf | 104/162 X |
| 3,499,524 | 3/1970 | Milazzo | 198/747 X |
| 3,512,629 | 5/1970 | Torrance | 198/747 X |
| 3,706,286 | 12/1972 | Ricaud et al. | 104/172 S |
| 3,712,241 | 1/1973 | Kuwertz | 104/103 X |
| 3,742,861 | 7/1973 | Wilkinson | 104/96 |
| 3,841,468 | 11/1974 | Eggert | 198/741 |
| 3,891,096 | 6/1975 | Terada | 198/741 X |
| 4,018,328 | 4/1977 | Galarowic et al. | 198/747 X |
| 4,408,540 | 10/1983 | Dehne | 104/172 B |
| 4,480,739 | 11/1984 | Haeusler | 198/619 X |
| 4,574,706 | 3/1986 | Dehne | 104/162 |

FOREIGN PATENT DOCUMENTS

| | | | |
|---|---|---|---|
| 3128290 | 7/1981 | Fed. Rep. of Germany | 198/619 |

*Primary Examiner*—Robert B. Reeves
*Assistant Examiner*—Glenn B. Foster
*Attorney, Agent, or Firm*—Joseph W. Farley

[57] ABSTRACT

A conveyor includes carriers supported on a carrier track, pushers supported on an adjacent power track, and a work station located along the carrier track. Each carrier is propelled to a pick-up station in advance of the work station by engagement of one of the pushers with a driving dog on the carrier. A carriage, movable between the pick-up station and a discharge station following the work station and having releasable coupling devices adapted to engage carriers at the pick-up and work stations, is reciprocatably driven on forwarding and return movements by a linear motor. On the forwarding carriage movement, carriers at the pick-up and work station are rapidly advanced to the work and discharge station, respectively, and the coupling devices are released prior to the return movement of the carriage. A carrier advanced to the discharge station is re-engaged by one of the pushers of the conveyor.

16 Claims, 6 Drawing Figures

METHOD OF AND APPARATUS FOR ADVANCING CONVEYOR CARRIERS THROUGH A WORK STATION

SUMMARY OF THE INVENTION

This invention relates generally to a conveyor of the power and free type in which carriers are normally propelled along a carrier track by engagement of a driving dog on each carrier with one of a plurality of pushers supported by a power track mounted adjacent to the carrier track. In particular, the invention relates to the incorporation in such a power and free conveyor of a reciprocatable shuttle carriage operable to advance successive carriers to a work station located along the carrier track, and from the work station to a following station after some desired operation has been performed at the work station on the article supported by each carrier.

Frequently, the nature of an operation desired to be performed at a particular work station on articles being conveyed requires that each article carrier be stopped at the station for a time period such as to adversely effect the production rate of the conveyor as a whole. One conventional solution to this problem is to provide duplicate parallel work stations, although the costs of installing, operating and maintaining duplicate stations can be considerable.

The present invention provides a method and apparatus which enable conveyor carriers to be advanced to a work station, and from that station to a following station, at speeds in excess of those at which the carriers can be driven by the conveyor, thereby reducing the station-to-station travel fime and increasing the time available for the work station operation.

The method of this invention, applicable to a power and free conveyor having carriers on which articles are supported and processed through a work station, increases the time available for performing a processing operation at the work station and comprises the steps of:

a. advancing successive carriers by the power and free conveyor to a pick-up station in advance of the work station;
b. coupling a first carrier at the pick-up station to a reciprocatable linear motor propelled carriage having a rearward portion to which the first carrier is coupled and a forward portion spaced from said rearward portion by a distance equal to the distance between the pick-up and work stations;
c. rapidly accelerating and decelerating the carriage to advance the first carrier to the work station;
d. uncoupling the first carrier from the carriage and returning the carriage to the pick-up station during the performance of the processing operation on an article conveyed by the first carrier;
e. coupling the first carrier and a second carrier to the forward and rearward portions, respectively, of the carriage;
f. rapidly accelerating and decelerating the carriage to advance the first carrier to a station following the work station and the second carrier to the work station;
g. uncoupling the first and second carriers from the carriage and returning the carriage to the pick-up station during the performance of the processing operation on an article conveyed by the second carrier;

h. coupling the second carrier and a third carrier to the forward and rearward portions, respectively, of the carriage; and,
i. repeating the foregoing steps f, g and h with respect to the second, third, and successive carriers.

In a power and free conveyor in which each carrier has article supporting structure connected to forward and rearward load supporting trolleys, the method of the invention may further comprise the step of placing the forward and rearward trolleys of each carrier on separate parallel tracks in advance of the pick-up station, thereby positioning the article supporting structure transversely of the parallel tracks, and extending the parallel tracks through the work station and at least to the following station.

Suitable apparatus for performing the foregoing steps, together with other features and advantages of the invention, will appear from the description to follow of the embodiment disclosed in the accompanying drawings.

DETAILED DESCRIPTION

Figure 1:
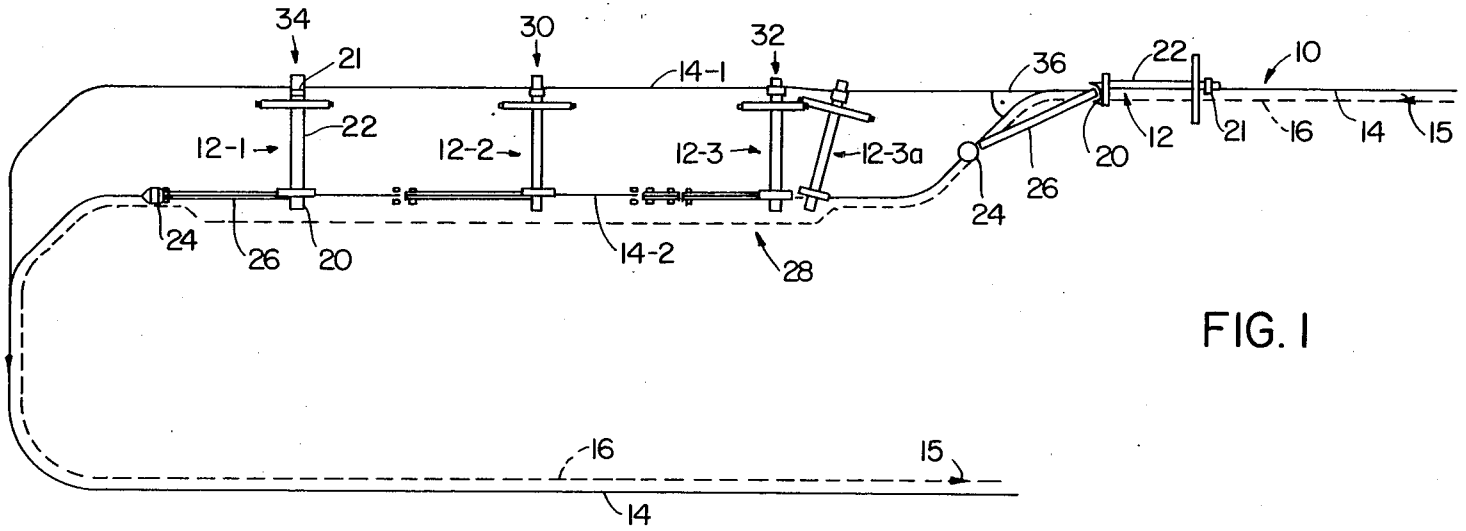
FIG. 1 is a schematic plan view of a portion of conveyor system incorporating the present invention.
Figure 2:
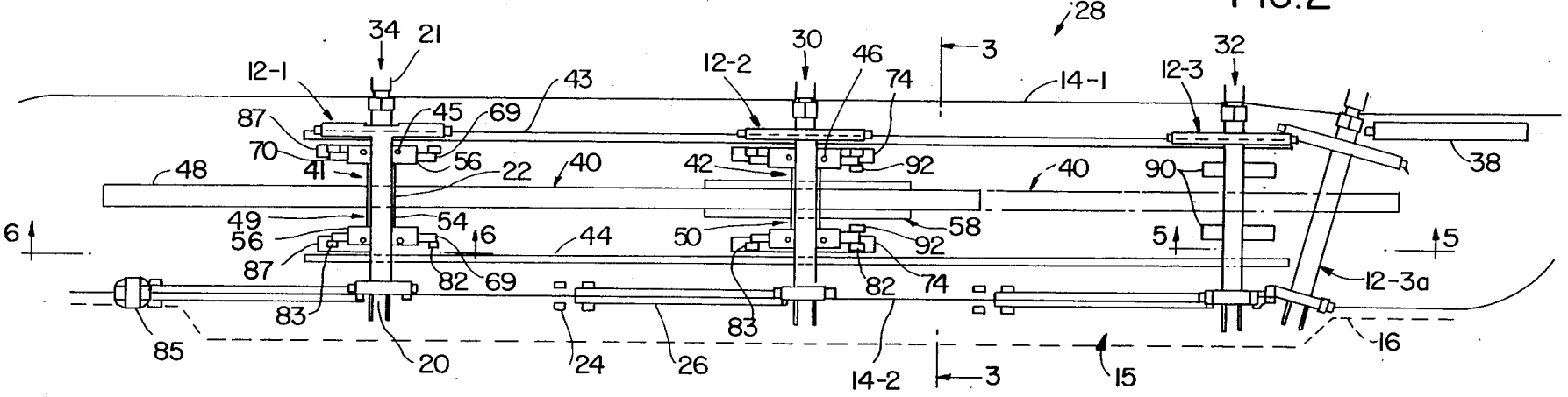
FIG. 2 is an enlarged schematic plan view of a part of FIG. 1, and showing a shuttle carriage for advancing carriers between successive pick-up, work, and following stations.

FIGS. 1 and 2 schematically illustrate a power and free conveyor 10 of a type which may be constructed in accordance with the disclosure of U.S. Pat. No. 4,408,540, incorporated herein by reference. Carriers 12, 12-1, 12-2 and 12-3 are supported on a carrier track 14 (represented by the solid line) and are propelled in the direction indicated by the arrows 15 by power means 16 (represented by the broken line) including a power track 18 (FIG. 3) which is located below the carrier track 14. The power means 16 comprises a driven chain connected to trolleys mounted on the power track and provided with pushers projecting toward the carrier track, each carrier having a driving dog engageable in a driving position by one of the pushers. All of these elements are shown in the above-referenced patent, together with a carrier stop which causes a carrier driving dog to be disengaged from a propelling pusher.

Each of the carriers 12 illustrated includes a first or forward load carrying trolley 20, a second or rearward load carrying trolley 21, and a load or article support 22 connecting the load carrying trolleys at a normal longitudinal spacing. A driving trolley 24, which is provided with the driving dog, is connected to the first trolley 20 of each carrier by a tow bar 26.

A work processing area 28 is illustrated in FIG. 1, is shown schematically in greater detail in FIG. 2, and includes a work station 30 for the performance of an operation on articles being conveyed by the carriers 12, a pick-up station 32, and a discharge station 34. All these stations are located along the carrier track 14, the pick-up station 32 being located in advance of the work station 30, and the discharge station 34 being located following the work station 30. The carrier track 14 branches in advance of the pick-up station 32 into first and second carrier tracks 14-1 and 14-2 which extend through the processing area in parallel relation and at a transverse spacing which does not exceed and is preferably equal to the normal longitudinal spacing of the first and second load carrying trolleys 20 and 21 of each carrier. A switch 36 is provided at the junction between the carrier tracks 14-1 and 14-2 for diverting the driving trolley 24 and first trolley 20 of each carrier onto the first carrier track 14-1 and the second trolley 21 of each carrier onto the carrier track 14-2. As a result, the load support 22 of each carrier extends transversely between the parallel first and second carrier tracks 14-1 and 14-2, preferably in a substantially normal relation therewith.

Each carrier is positioned at the pick-up station 32 in disengaged relation with the power means 16 by increasing the spacing between the carrier track 14-1 and the power track 18, as schematically shown in FIGS. 1 and 2. In the construction illustrated, an auxiliary carrier driving device, such as a fluid pressure cylinder assembly 38, is preferably employed for advancing a carrier from the position of the carrier 12-3*a* into the pick-up station 32. The power means 16 is returned to engageable relation with the carriers at the discharge, or following station 34.

Figure 3:
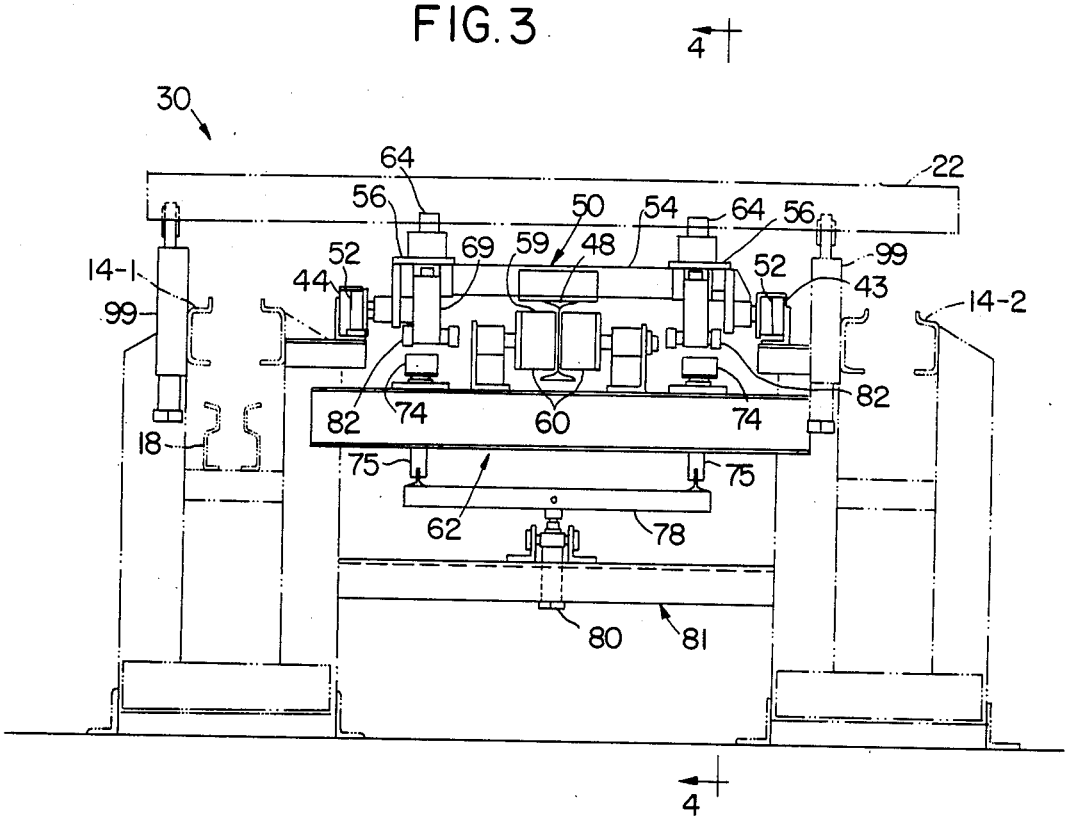
FIG. 3 is a transverse sectional elevation taken substantially as indicated by the line 3—3 of FIG. 2, showing a carrier at the work station.

Referring to FIGS. 2 and 3, a shuttle carriage assembly 40, having a front portion 41 and a rear portion 42 longitudinally spaced apart a distance corresponding to the distance between the pick-up station 32 and the work station 30, is movably supported on a pair of parallel, transversely spaced shuttle carriage track members 43 and 44 which extend between the pick-up station 32 and the following station 34. Front and rear releasable carrier coupling means 45 and 46 are respectively mounted on the front and rear portion 41 and 42.

The shuttle carriage 40 comprises a longitudinally extending I-beam frame member 48, transversely extending front and rear frame structures 49 and 50 connected to the frame member 48, and wheels 52 carried by each of the frame structures 49 and 50 for engaging the track members 43 and 44. Each of the frame structures 49 and 50 includes a transverse portion 54 and a pair of longitudinal portions 56 connected to the ends of the transverse portion, the frame member 48 being secured to the transverse portions 54 and being arranged substantially intermediate of the track members 43 and 44.

Figure 4:
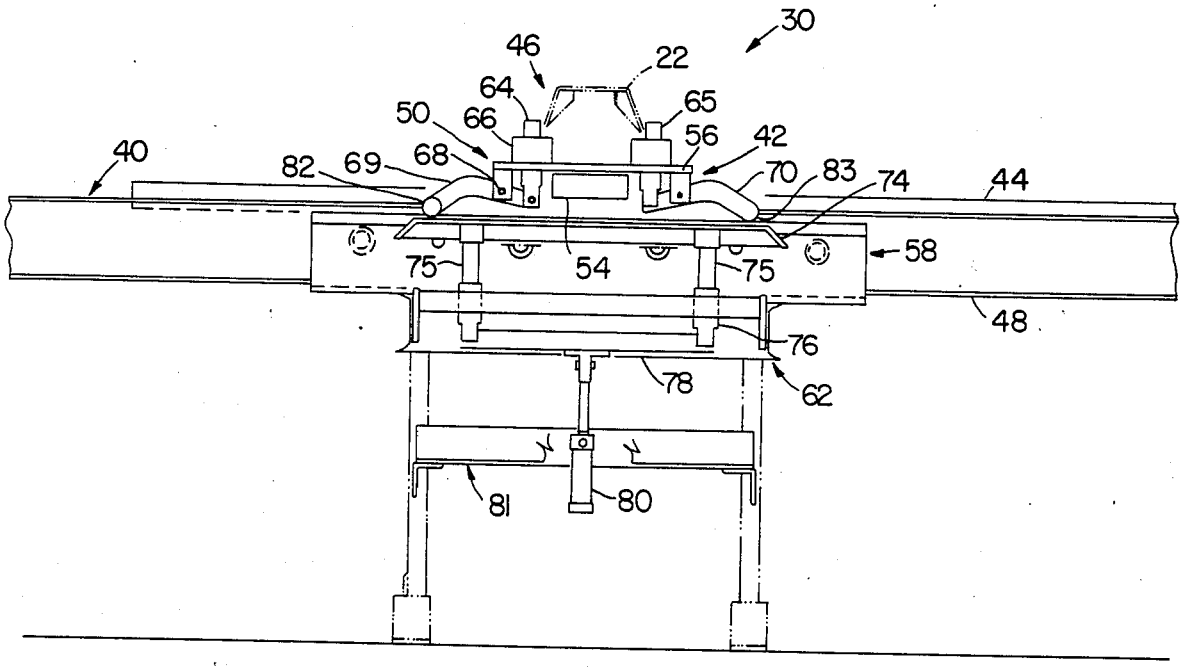
FIG. 4 is a longitudinal sectional elevation of the work station, taken substantially as indicated by the line 4—4 of FIG. 3.

The shuttle carriage 40 is reciprocatably driven between a forward position, shown in solid line in FIG. 2, and a return position (indicated in broken line) by propulsion means comprising a linear motor 58 having a reactor formed by the vertically disposed web 59 of the I-beam frame member 48, and a stator formed by coil units 60 which are fixedly mounted in opposed relation to the web 59 on stationary framework structure 62 provided at the work station area, as shown in FIGS. 3 and 4.

Referring to FIGS. 2–4 and 6, each of the front and rear releasable carrier coupling means 45 and 46 comprises two pairs of coupling elements, each pair consisting of a driving element 64 and a holdback element 65. Each of these elements is a vertically movable pin, mounted in a bushing 66 carried by one of the longitudinal portions 56 of the shuttle carriage frame structures 49 and 50, and connected to an actuator supported on a pivot 68 (FIG. 4) for movement thereby between engageable and non-engageable positions relative to the load support 22 of each carrier. Each actuator for a driving element 64 is identified by the reference 69; and, each actuator for a holdback element 65 is identified by the reference 70.

Releasing means are mounted at the work station 30 and at the following station 34 for disengaging carriers at those stations from the front and rear carrier coupling means 45 and 46. The releasing means at the work station is best shown in FIGS. 3 and 4, and comprises a pair of transversely spaced cam tracks 74 each supported by a pair of rods 75 slidably mounted in bushings 76. All of the rods 75 are connected to a frame 78 selectively movable upwardly and downwardly by an actuating cylinder 80 carried by fixed structure 81. Thus, the cam tracks 74 are movable from the lowered position shown in FIG. 3 to the raised position shown in FIG. 4 in which the cam tracks are in engageable relation with a cam follower 82 on each driving element actuator 69 and with a cam follower 83 on each holdback element actuator 70.

Figure 6:
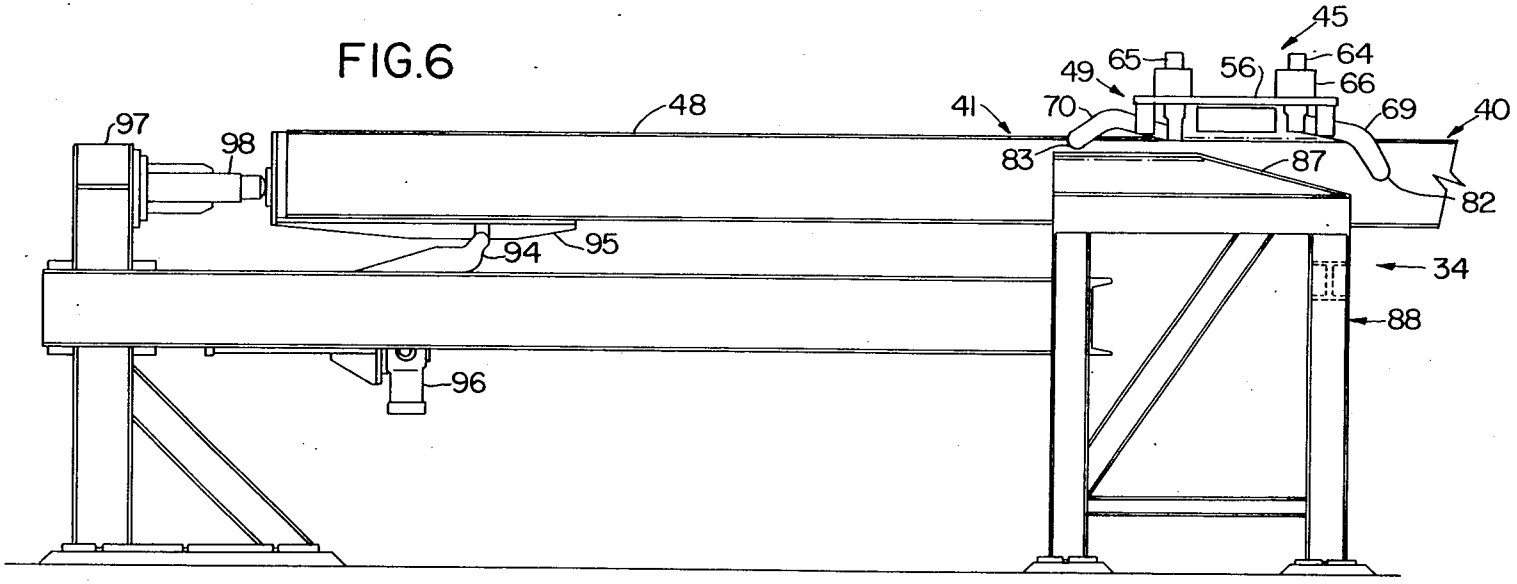
FIG. 6 is a longitudinal elevation taken as indicated by the line 6—6 of FIG. 2 showing details of the following station.

The releasing means at the following station 34 is best shown in FIGS. 2 and 6, and consists of a pair of transversely spaced cam tracks 87 which are secured to fixed structure 88 and are engageable by the cam follower 83 on each holdback element actuator 70 of the front carrier coupling means 45.

Figure 5:
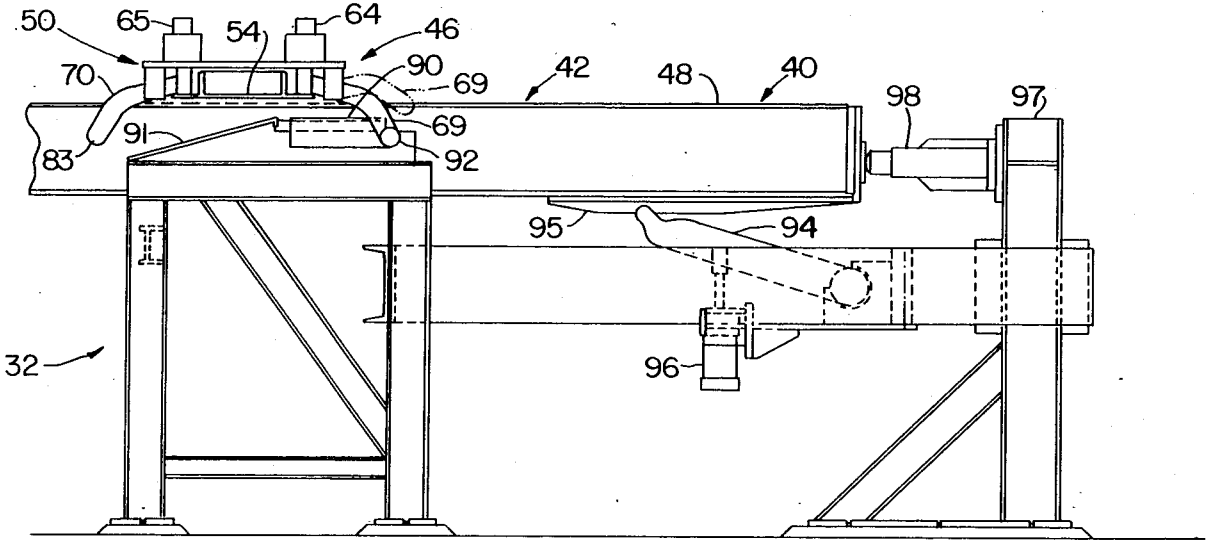
FIG. 5 is a longitudinal elevation taken as indicated by the line 5—5 of FIG. 2 showing the shuttle carriage in the pick-up station and details of that station.

FIGS. 2 and 5 show that the pick-up station 32 includes a pair of cam tracks 90 which are transversely spaced a distance less than the transverse spacing of the cam tracks 74 and 87. Each of the cam tracks 90 has a horizontally pivoted ramp or gate portion 91 and is engageable by an inner cam follower 92 provided on each of the driving element actuators 69 of the rear carrier coupling means 46 in response to return movement of the shuttle carriage 40. When the shuttle carriage reaches its return position shown in FIG. 5, the cam followers 92 are moved beyond the cam tracks 90 causing the gravity-biased actuators 69 to fall to the solid line position and the driving elements 64 to raise into engageable relation with the load support 22 of a carrier.

FIG. 5 also shows that the structure of the pick-up station 32 includes a pivotal latch 94, engageable by a detent 95 on the frame member 48 of the shuttle carriage 40, and releasable by an actuator 96. A bumper 97, provided with a shock absorber 98, is engageable by the end of the frame member 48 to prevent overtravel of the shuttle carriage. Corresponding releasable latch elements and bumper structure are provided at the following station 34, as shown in FIG. 6, and are designated by the same reference numbers.

To describe the mode of operation of the conveyor, it will be assumed that none of the carriers 12-1, 12-2 and 12-3 are in the processing area 28, as shown in FIGS. 1 and 2, but are being forwarded in sequence to the processing area by the power and free conveyor 10, carrier 12-1 being the first carrier, carrier 12-2 the second carrier and carrier 12-3 the third carrier. These carriers are advanced successively to the pick-up station 32 by the power and free conveyor, with their forward and rearward load supporting trolleys 20 and 21 on the separate parallel carrier tracks 14-1 and 14-2 and with the carrier load support 22 in a substantially normal relation to these parallel tracks as each carrier enters the pick-up station, aided by operation of the auxiliary carrier driving means 38.

When the first carrier 12-1 is thus advanced to the pick-up station 32, the shuttle carriage 40 is moved to its return position (shown in FIG. 5) by energizing the coil units 60 of the linear motor 58, and the first carrier is coupled to the rear portion 42 of the shuttle carriage 40, the carrier load support 22 being positioned between the pairs of driving elements 64 and hold back elements 65 on the rear portion 42 of the shuttle carriage. The driving element actuators 69 drop to the full line position shown in FIG. 5 and their cam followers 92 are movable in the forward direction under the cam tracks 90, causing the cam track gates 91 to pivot upwardly.

By suitably energizing and deenergizing the linear motor stator coil units 60, the shuttle carriage 40 is rapidly accelerated and decelerated from its rearward to its forward position, advancing the first carrier 12-1 from the pick-up station 32 to the work station 30. The linear motor propulsion of the shuttle carriage offers the advantages of instantaneous response, and speeds infinitely variable over a wide range from low to high and return, with relatively simple components.

The first carrier 12-1, now in the work station 30, is uncoupled from the shuttle carriage 40 by energizing the actuating cylinder 80 to raise the work station cam tracks 74 into engagement with the driving and holdback element actuators 69 and 70 on the rear portion 42 of the shuttle carriage 40, thereby moving the pairs of driving and holdback elements 64 and 65 to non-engageable positions relative to the load support 22 of the first carrier 12-1. Optional carrier engaging units 99 (FIG. 3) may be provided at the work station 30 and are actuated prior to the uncoupling of the carrier from the shuttle carriage 40 to positively position the carrier for the performance of a processing operation on an article supported thereby.

During the performance of that operation, the second carrier 12-2 is advanced to the pick-up station 32, the actuator 80 for the work station cam tracks 74 remains energized, and the uncoupled shuttle carriage 40 is returned by the linear motor 58 to the pick-up station. When the shuttle carriage 40 reaches its return position, the first carrier 12-1 is coupled to the front portion 41 of the carriage by deenergizing the actuator 80 and the second carrier 12-2 is coupled to the rear portion 42 of the carriage by the action of the pick-up station cam tracks 90, 91.

The linear motor coil units are again energized and deenergized to rapidly accelerate and decelerate the shuttle carriage 40 to the forward position, thereby advancing the first carrier 12-1 to the following station 34 and the second carrier 12-2 to the work station 30. When the shuttle carriage reaches its forward position, the first carrier 12-1 is uncoupled from the front carriage portion 41 as a result of the engagment of the cam tracks 87 at the following station 34 by the cam followers 83 on the holdback element actuators 70. This engagement causes the holdback elements 65 on the front carriage portion 41 to be retracted to a non-engageable position relative to the load support 22 of the first carrier 12-1 and to be held in that position during the initial portion of the next return movement of the shuttle carriage 40. The second carrier 12-2 is uncoupled from the rear carriage portion 42 by raising the work station cam tracks 74, as previously described.

During the performance of the processing operation on an article conveyed by the second carrier 12-2, the third carrier 12-3 is advanced to the pick-up station 32, the first carrier 12-1 is held by a stop 85 in position to be advanced from the following station by the power and free conveyor, and the apparatus is in the condition illustrated in FIGS. 1 and 2. The uncoupled shuttle carriage is then returned to the pick-up station. Upon reaching the return position, the second carrier 12-2 is coupled to the front carriage portion 41, the third carrier 12-3 is coupled to the rear carriage portion 42, and the shuttle carriage 40 is ready for the next advance motion. Prior to that motion, the first carrier 12-1 will have been engaged by the power means 16 of the power and free conveyor 10 and moved out of the following station 34.

Those skilled in the art will recognize that modifications of the apparatus disclosed and described will be necessitated by the physical characteristics of the articles to be handled as well as by the nature of a particular processing operation to be performed on those articles. Such modifications will include, for example, the use of an overhead type of power and free conveyor in lieu of the inverted type disclosed, and changes in the carriers in order to adapt them to the articles, which changes may in turn require variations in the structure of the shuttle carriage.

What is claimed is:

1. In a conveyor having carriers supported on a carrier track, a power track mounted invertically spaced relation to the carrier track and supporting power means including pushers projecting toward the carrier track, each carrier having a driving dog engageable in a driving position by one of the pushers, and a work station at a location along the carrier track for performance of an operation on articles being conveyed by the carriers, the improvement comprising:

a pick-up station located along the carrier track in advance of said work station;

a station located along the carrier track following said work station;

means for positioning a carrier in disengaged relation with said power means between said pick-up station and said following station;

a shuttle carriage having a front portion and a rear portion, front and rear releasable carrier coupling means respectively mounted on said front and rear shuttle carriage portions for connecting carriers thereto by driving and holdback elements at a longitudinal spacing corresponding to the distance between said pick up and work stations;

shuttle carriage track means extending between said pick-up and following stations for movably supporting said shuttle carriage;

propulsion means for reciprocatably driving said shuttle carriage between forward and return positions, said front and rear releasable carrier coupling means being respectively engageable in said return position with carriers supported by the carrier track at said work and pick-up stations, whereby such carriers engaged by said releasably coupling means are respectively propelled by said shuttle carriage along the carrier track to said following station and said work station in response to forward movement of said shuttle carriage by said propulsion means; and releasing means mounted at said work station and at said following station for disengaging carriers from said front and rear carrier coupling means.

2. A conveyor according to claim 1 wherein said following station is a discharge station at which said power means is arranged in engageable relation with carriers.

3. A conveyor according to claim 1 wherein said propulsion means comprises a linear motor having a reactor part and a stator part, one of which parts is connected to said shuttle carriage and the other of which parts is supported by fixed structure.

4. A conveyor according to claim 1 wherein said shuttle carriage comprises a longitudinally extending frame member, supporting means carried by said frame member for engaging said shuttle carriage track means, and said propulsion means comprises a linear motor having a reactor and a stator, said reactor being formed by said frame member and said stator being formed by at least one coil unit fixedly mounted alongside of the path of reciprocating movement of said frame member.

5. A conveyor according to claim 4 wherein said frame member includes a vertically disposed web forming said reactor, and said stator is formed by at least a pair of coil units fixedly mounted in opposed relation to said web.

6. A conveyor according to claim 5 wherein said shuttle carriage track means comprises a pair of track members spaced apart transversely of the path of reciprocating movement of said shuttle carriage, said supporting means carried by said frame member comprising longitudinally spaced transversely extending frame structures connected to said frame member adjacent to its front and rear ends, wheels carried by each transversely extending frame structure and engaging said pair of track members, said frame member being arranged substantially intermediate of said pair of track members.

7. A conveyor according to claim 6 wherein said front and rear releasable carrier coupling means are each mounted on one of said transversely extending frame structures.

8. A conveyor according to claim 6 wherein each of said carriers includes first and second load carrying trolleys, and a load support connecting said load carrying trolleys at a normal longitudinal spacing;

said carrier track branches in advance of said pick-up station into first and second carrier tracks arranged between said pick-up and following stations at a transverse spacing not exceeding to said normal longitudinal spacing of the first and second load carrying trolleys;

switch means for diverting the first and second load carrying trolleys of each carrier onto said first and second carrier tracks respectively whereby the load support of each carrier extends between said first and second carrier tracks; and each of said front and rear releasable carrier coupling means mounted on said shuttle carriage comprises a pair of transversely spaced driving elements engageable with said load support.

9. A conveyor according to claim 8 wherein said first and second carrier tracks are arranged at a transverse spacing corresponding to said normal longitudinal spacing of the first and second load carrying trolleys.

10. A conveyor according to claim 8 wherein said means for positioning a carrier at said pick-up station includes auxiliary carrier driving means for advancing each carrier into said pick-up station.

11. A conveyor according to claim 8 wherein each of said front and rear releasable carrier coupling means comprises two pairs of driving and holdback elements, each element being movable between engageable and non-engageable positions relative to said load support and being connected to an actuator for movement thereby, and said releasing means mounted at said work station and at said following station comprises cam means engageable by at least certain of said actuators.

12. A conveyor according to claim 11 wherein said cam means at said work station comprises a pair of transversely spaced cam tracks selectively movable into engageable relation with the actuators of the front and rear releasable carrier coupling means.

13. A conveyor according to claim 11 wherein said cam means at said following station comprises a pair of transversely spaced fixed cam tracks engageable by the holdback element actuators of said front releasable carrier coupling means.

14. A conveyor according to claim 11 wherein said pickup station includes cam means engageable by the driving element actuators of said rear releasable carrier coupling means in response to return movement of said shuttle carriage.

15. In a conveyor having a carrier track supporting carriers on which articles are mounted and processed through at least one work station, and a power track normally positioned adjacent to the carrier-track and supporting power means for propelling the carriers along the carrier track, a method of increasing the time available for performing a processing operation at said work station comprising the steps of:

a. advancing successive carriers by the power means to a pick-up station in advance of the work station and disengaging the carriers from the power means;

b. positively coupling a first carrier at the pick-up station to a reciprocatable linear motor propelled carriage having a rearward portion to which said first carrier is coupled and a forward portion spaced from said rearward portion by a distance equal to the distance between said pick-up and work stations;

c. rapidly accelerating and decelerating said carriage to advance said first carrier along the carrier track to the work station;

d. uncoupling said first carrier from said carriage and returning said carriage to said pick-up station during the performance of said processing operation on an article conveyed by said first carrier;

e. positively coupling said first carrier and a second carrier to said forward and rearward portions, respectively, of said carriage;

f. rapidly accelerating and decelerating said carriage to advance along the carrier track said first carrier to a station following said work station and said second carrier to said work station;

g. uncoupling said first and second carriers from said carriage and returning said carriage to the pick-up station during the performance of said processing operation on an article conveyed by said second carrier;

h. positively coupling said second carrier and a third carrier to said forward and rearward portions, respectively, of said carriage;

i. re-engaging said first carrier by the power means;

j. and repeating the foregoing steps f, g, h and i with respect to said second, third, and successive carriers.

16. The method set forth in claim 15 for use with a conveyor system in which each of the carriers has article supporting structure connected to forward and rearward load supporting trolleys, further comprising the step of placing the forward and rearward trolleys on separate parallel carrier tracks in advance of said pick-up station and positioning the load supporting structure of each carrier in a substantially normal relation to said parallel carrier tracks at said pick-up station.

* * * * *

UNITED STATES PATENT AND TRADEMARK OFFICE

CERTIFICATE OF CORRECTION

PATENT NO. : 4,669,388

DATED : June 2, 1987

INVENTOR(S) : Clarence A. Dehne et al

It is certified that error appears in the above—identified patent and that said Letters Patent is hereby corrected as shown below:

Column 6, line 32, "invertically" should read --in vertically--

Column 6, line 65, "releasably" should read --releasable--.

Signed and Sealed this

Twenty-second Day of September, 1987

*Attest:*

DONALD J. QUIGG

*Attesting Officer* *Commissioner of Patents and Trademarks*